US011802690B2

(12) United States Patent
Miyagi et al.

(10) Patent No.: US 11,802,690 B2
(45) Date of Patent: Oct. 31, 2023

(54) REUSABLE WAX CANDLE HOLDER AND METHODS

(71) Applicants: Haruvoshi Miyagi, Holladay, UT (US); Jonah Miyagi, Murray, UT (US)

(72) Inventors: Haruvoshi Miyagi, Holladay, UT (US); Jonah Miyagi, Murray, UT (US)

(73) Assignee: Yuno LLC, Lehi, UT (US)

( * ) Notice: Subject to any disclaimer, the term of this patent is extended or adjusted under 35 U.S.C. 154(b) by 0 days.

(21) Appl. No.: 17/579,588

(22) Filed: Jan. 19, 2022

(65) Prior Publication Data

US 2022/0390100 A1 Dec. 8, 2022

Related U.S. Application Data

(60) Provisional application No. 63/139,303, filed on Jan. 19, 2021.

(51) Int. Cl.
*F23D 3/16* (2006.01)

(52) U.S. Cl.
CPC ..... *F23D 3/16* (2013.01)

(58) Field of Classification Search
CPC ..... F21V 35/00; F23D 3/16
USPC ..... 431/291, 288, 295; 215/21.1
See application file for complete search history.

(56) References Cited

U.S. PATENT DOCUMENTS 370,562 A 9/1887 Schmitt
816,790 A 4/1906 Genovese
1,292,195 A * 1/1919 Will ..... F21V 35/00 362/163
1,320,109 A 10/1919 Wooster
1,344,446 A 6/1920 Engman
1,474,910 A * 11/1923 Petersen ..... F21V 35/00 431/297
2,137,701 A 11/1938 Replogle
2,291,067 A 7/1942 Atkins
2,312,640 A 3/1943 Guilfoil
3,105,373 A 10/1963 De Georges
3,403,714 A 10/1968 Hulm
3,483,908 A 12/1969 Donovan
3,583,853 A 6/1971 Schramm
3,797,990 A 3/1974 Ogers
3,918,888 A 11/1975 Clarke
D247,635 S 3/1978 Maxwell
4,755,135 A 7/1988 Kwok
5,690,484 A 11/1997 Leonard
6,428,310 B1 8/2002 Scannell
6,793,484 B2 9/2004 Pesu
D507,667 S 7/2005 Aucoin
(Continued)

*Primary Examiner* — Vivek K Shirsat
(74) *Attorney, Agent, or Firm* — Kimball Anderson; Jeffery M. Lillywhite

(57) ABSTRACT

A candle assembly includes a candle holder configured to hold a candle block. The candle holder has an opening, a wall and base. The wall is attached around the periphery of the base. The opening is positioned opposite the base. The base includes an aperture extending through the thickness of the base. An inner liner is placed in the candle holder and configured to fit tightly against the wall and to provide a watertight container for the candle block. The inner liner has an exposed portion across the aperture to define a button. A rim is attached to the wall opposite the base and configured to extend into the candle holder at least the thickness of the inner liner and to secure the inner liner within the candle holder.

19 Claims, 10 Drawing Sheets

(56) References Cited

U.S. PATENT DOCUMENTS

| | | | |
|---|---|---|---|
| 8,348,662 | B2 | 1/2013 | Decker |
| 9,341,365 | B2 | 5/2016 | Gan |
| 9,599,330 | B2 | 3/2017 | Rutan |
| 10,371,372 | B2 | 8/2019 | Von Zell |
| D870,923 | S | 12/2019 | Panagiotis |
| 10,696,432 | B2 | 6/2020 | Levy |
| D919,840 | S | 5/2021 | Sablowski |
| 11,313,552 | B2 | 4/2022 | Wong |
| 2003/0064340 | A1 | 4/2003 | Pappas |
| 2004/0029061 | A1 | 2/2004 | Dibnah |
| 2015/0153039 | A1 | 6/2015 | Cremer |
| 2022/0316695 | A1 | 10/2022 | Pasteris |

* cited by examiner

REUSABLE WAX CANDLE HOLDER AND METHODS

CROSS-REFERENCE TO RELATED APPLICATIONS

This application claims the benefit of U.S. Provisional Patent Application Ser. No. 63/139,303, entitled "Reusabale Wax Candle Holder and Method," filed Jan. 19, 2021, which is incorporated herein by reference.

BACKGROUND OF THE INVENTION

1. The Field of the Invention

The present disclosure generally relates to candle holders for wax candles and, more particularly, to reusable wax candle holder designed for multiple uses.

2. The Relevant Technology

A scented candle has an ignitable wick embedded in wax. The candle illuminates and releases fragrances into a room when lit. A flame is used to light the wick and burn the candle, which melts and vaporizes a small amount of the wax. Dyes and fragrances can be mixed in with the wax for varying aesthetic appeal, and for releasing seasonal, therapeutic and pleasing scents. Glass jars are typically used as a candle holder for scented candles.

As the wax melts, the candle burns the vaporized wax as fuel and the volume of wax in the candle holder decreases. A portion of the wick that is not emitting the vaporized wax is consumed in the flame. The length of the wick decreases with the burn to an exposed portion where the vaporized wax is being burned. After the wax is burned to the bottom of the candle holder or the scent is no longer enjoyed, the glass jars are thrown away. The jars are typically thrown away after a single use.

The jars are cleaned by placing the used candle jar, with leftover wax residue, in a pot of boiling water. Once the wax melts, the user must take a paper napkin or towel and wipe the inside of the jar. In another method, the candle jar can be placed in a freezer to harden the wax. Once the wax freezes, the user can take a butter knife and chip off the frozen wax.

The liquid wax in the jar is hot and can cause skin burns. A candle snuffer is generally used to avoid being burned or from having hot wax splash out of the jar while blowing out the flame. A candle snuffer can be a small metal cup on the end of a long handle. The snuffer is placed over the flame on the wick to cut off the oxygen supply to the flame.

Glass jars can crack by thermal shock from the candle flame. In particular, when the candle burns down to the end of the wick, the heat from the flame may be hot enough to crack the glass.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

There is a large amount of waste generated each day from used candle jars. In the present invention, the candle holder, or glass jar, includes a liner to help release the wax from the candle holder. With the liner placed in the candle holder, the wax residue is easily removed. A new wax block can be inserted into the candle holder.

In one aspect of the invention, a candle assembly includes a candle block made substantially of a wax and including at least one wick. A candle holder has a cylindrical shape with an opening, a wall and base. The wall defines a continuous inside surface around the base. The base is positioned opposite the opening and includes an aperture extending through the thickness of the base. An inner liner is configured to fit tightly against the inside surface defined by the wall and across the entire base within the candle holder. The inner liner provides a barrier between the candle block and the candle holder. The inner liner has a nodule that is sized to fit within the aperture and through the thickness of the base to define a button. A rim is attached around the wall of the candle holder and configured to extend into the inner space of the candle holder to secure the inner liner within the candle holder.

In another aspect of the invention, a candle assembly includes a candle holder configured to hold a candle block. The candle holder has an opening, a wall and base. The wall is attached around the periphery of the base. The opening is positioned opposite the base. The base includes an aperture extending through the thickness of the base. An inner liner is placed in the candle holder and configured to fit tightly against the wall and to provide a watertight container for the candle block. The inner liner has an exposed portion across the aperture to define a button. A rim is attached to the wall opposite the base and configured to extend into the candle holder at least the thickness of the inner liner and to secure the inner liner within the candle holder.

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order to describe the manner in which the advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE VARIOUS EMBODIMENTS

Figure 1:
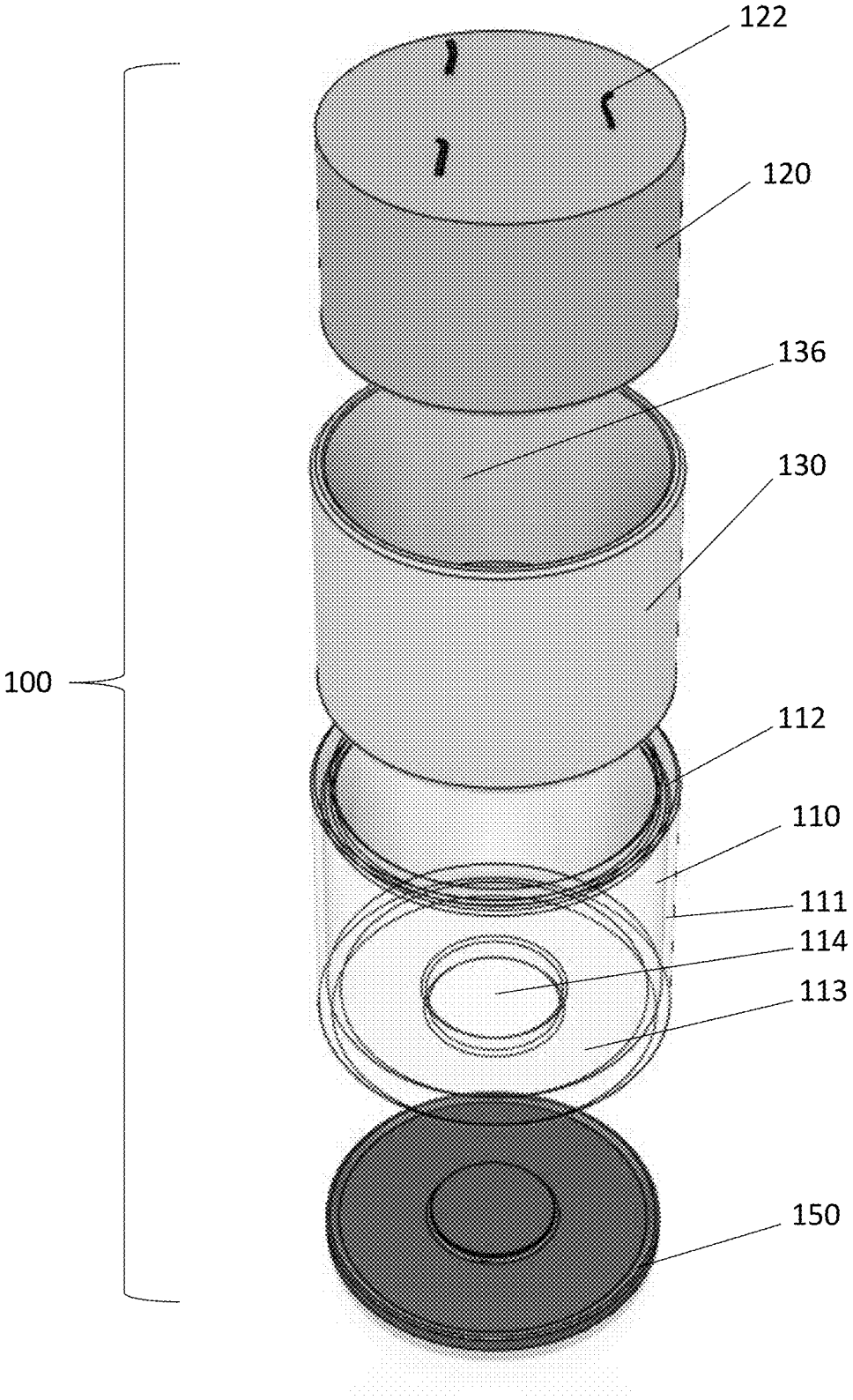
FIG. 1 is an assembly drawing of the candle showing various components in accordance with an embodiment of the present invention.
Figure 2:
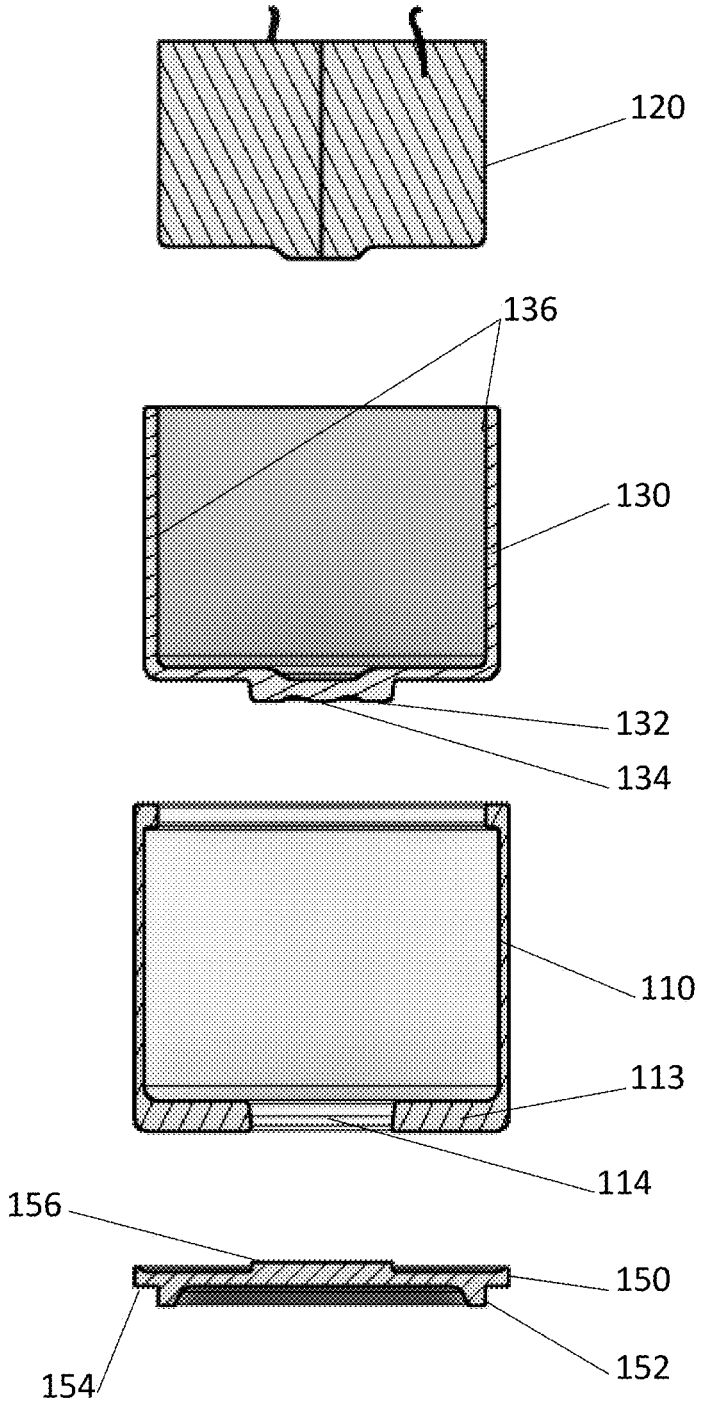
FIG. 2 is a cross-sectional view of the various components of the present invention in which the components are disassembled.
Figure 3:
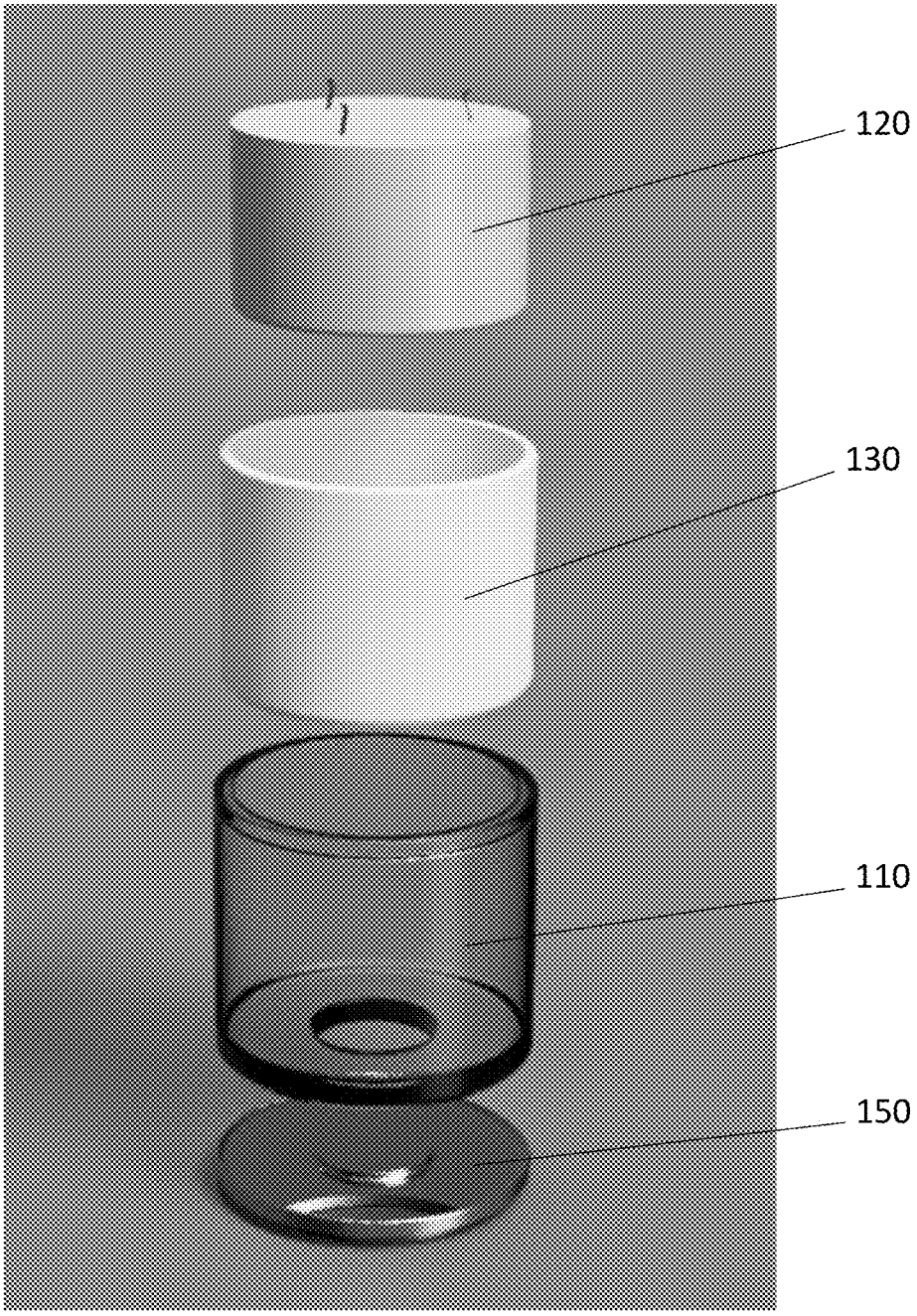
FIG. 3 is an isometric assembly view of the various components of the candle in accordance with the embodiments of the present invention.
Figure 4:
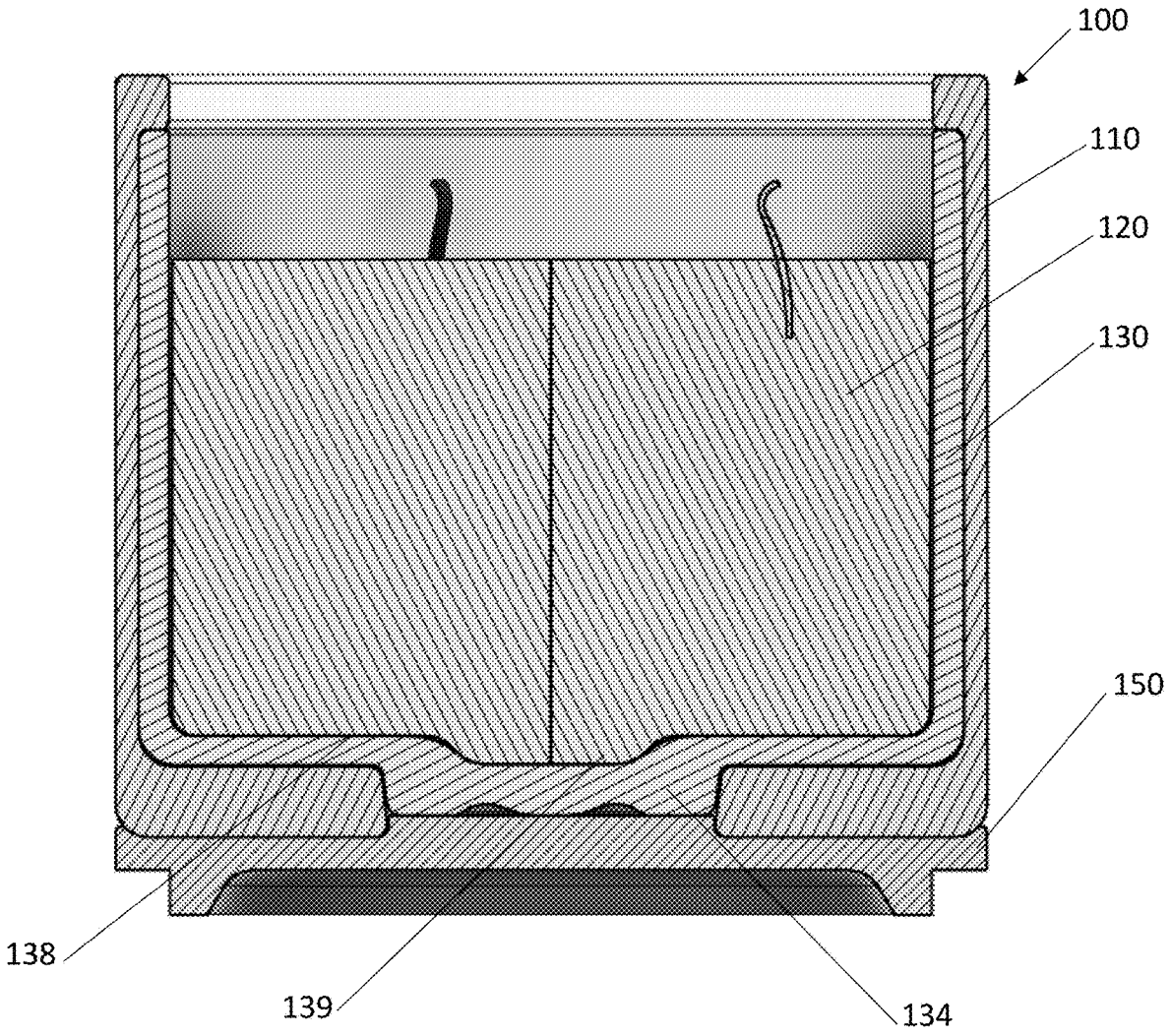
FIG. 4 is a cross-sectional view of the various components of the present invention in which the components are assembled and illustrated in an open position.
Figure 5:
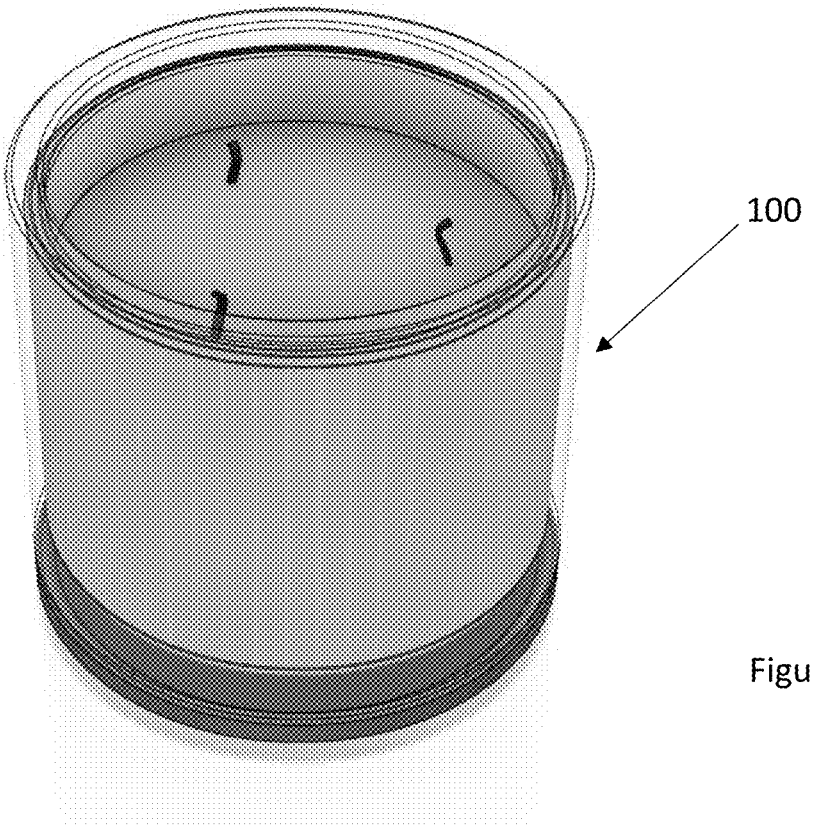
FIG. 5 is an isometric view of a candle in accordance with an embodiment of the present invention in an open position.
Figure 6:
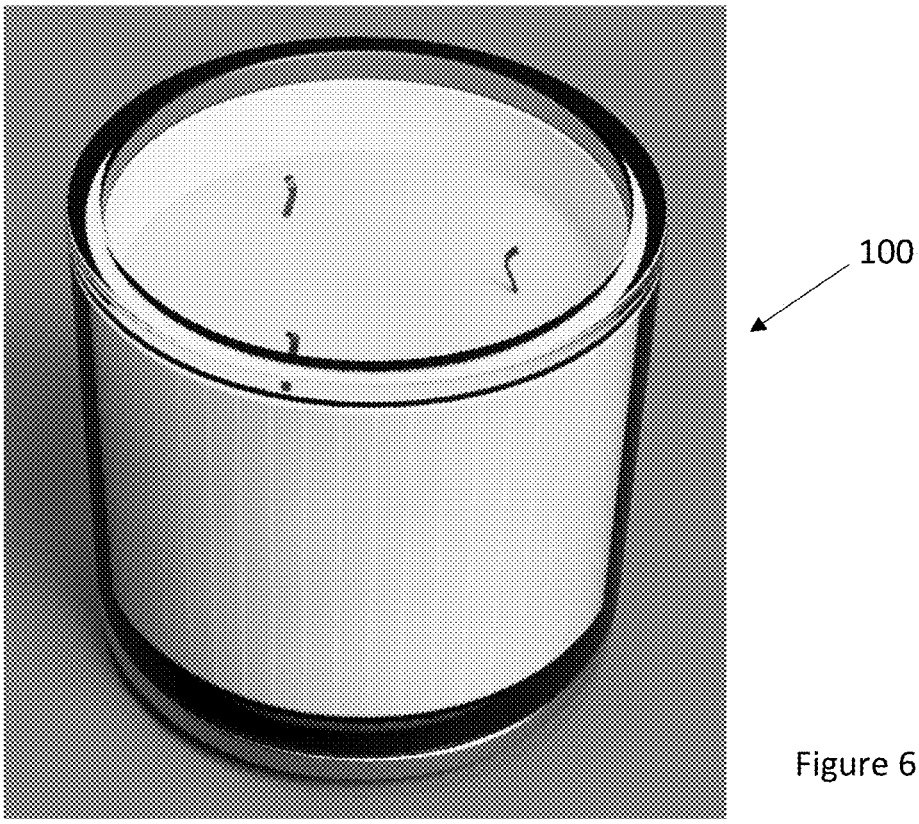
FIG. 6 is an isometric view of a candle in accordance with another embodiment of the present invention in an open position.
Figure 7:
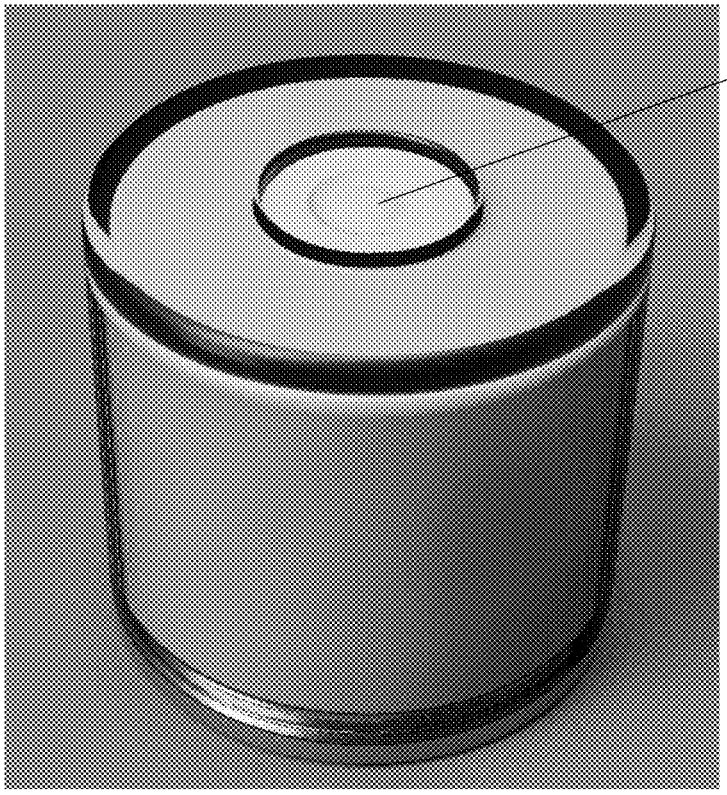
FIG. 7 is an isometric, bottom view of the candle illustrated in FIG. 6 in a closed position.
Figure 8:
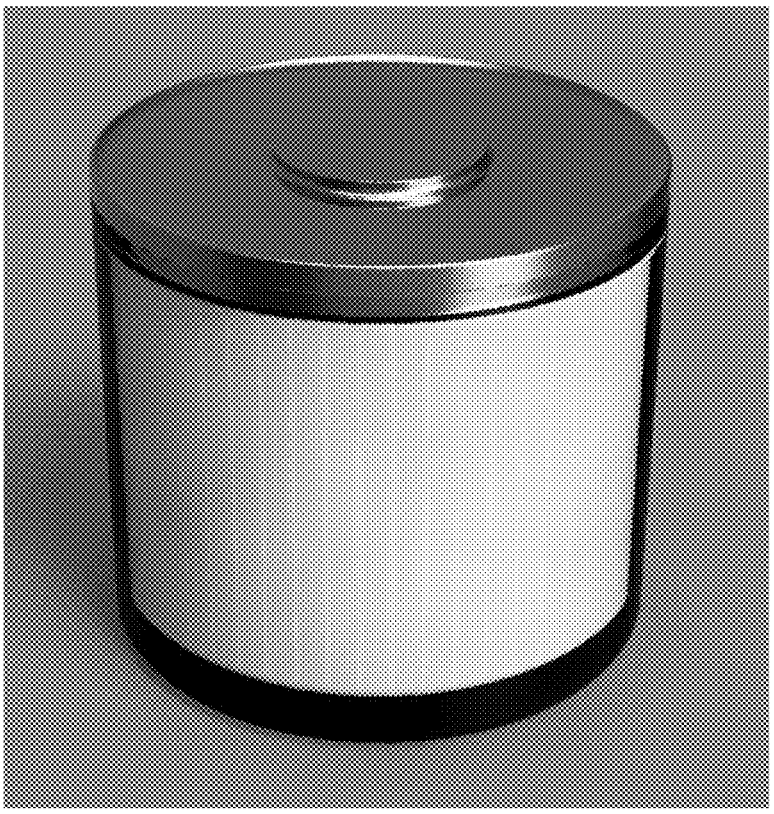
FIG. 8 is an isometric, top view of the candle illustrated in FIG. 6 in a closed position.
Figure 9:
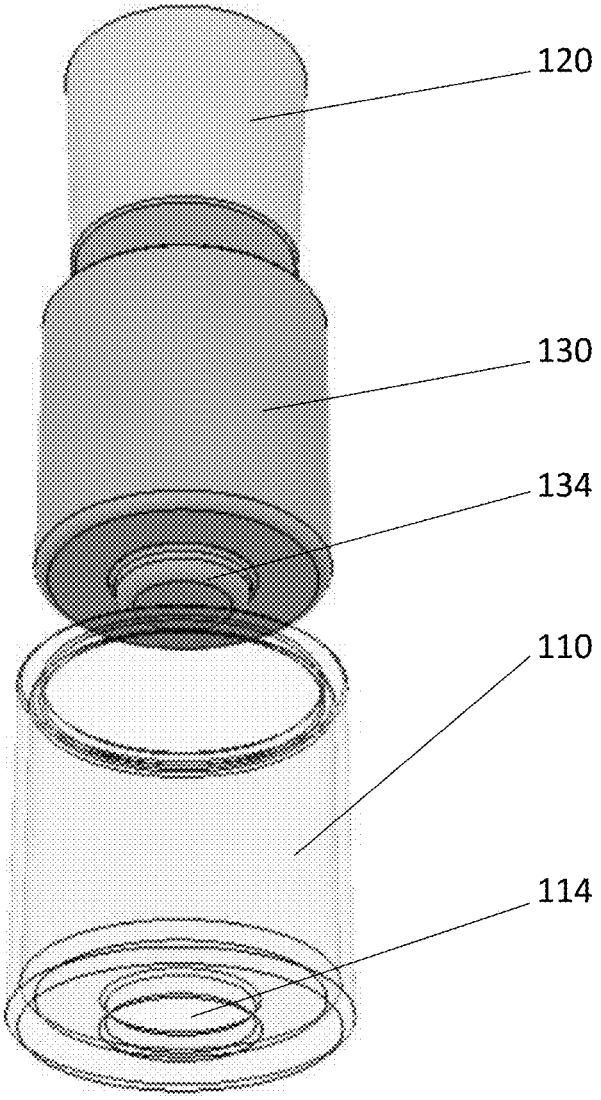
FIG. 9 is a bottom view of a candle assembly illustrating the candle holder, inner liner and candle block.
Figure 10:
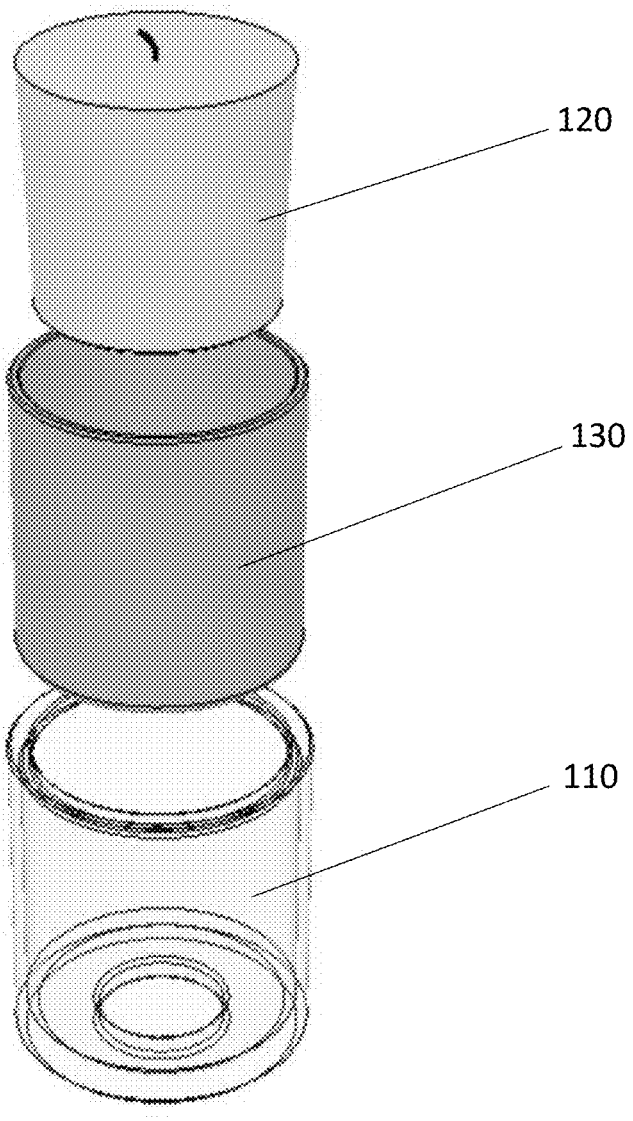
FIG. 10 is a top view of a candle assembly illustrating the candle holder, inner liner and candle block.

The present devices and methods include various embodiments of reusable candle holder for a candle block, such as a wax candle. The present invention reduces the time required to reuse jars after use of a candle or to replace another candle in the candle holder. The candle holders are designed to be used and reused in a much safer way than conventional candles.

As illustrated in FIGS. 1-4, a candle assembly 100 is provided with a candle holder 110 designed to hold a candle block 120. The candle block 120 is made substantially of a wax and includes at least one wick 122. The candle block 120 is inserted into a candle holder 110 made from a rigid material, such as glass, metal, plastic or other material used to hold candle wax. The candle holder 110 can have a cylindrical shape with wall 111, a rim 112, and a base 113, and can be shaped like a jar.

The candle holder 110 has an opening in the top to allow the candle to burn within the candle holder 110. The base 113 can include an aperture 114 that extends through the thickness of the base 113. The inside surface of the wall 111 and the base 113 defines an inner space. The wall 111 of the candle holder 110 defines a continuous inside surface around the base 113. The base 113 is positioned opposite the opening and includes an aperture extending through the thickness of the base 113. The rim 112 can be attached around the wall 111 of the candle holder 110 and can be configured to extend into the inner space of the candle holder 110 to secure the inner liner 130 within the candle holder 110.

The candle assembly 100 can include the candle holder 110 that is configured to hold a candle block 120. The wall 111 can be attached around the periphery of the base 113. The opening is positioned opposite the base 113. The base 113 includes an aperture extending through the thickness of the base 113. An inner liner 130 can be placed in the candle holder 110 and can be configured to fit tightly against the wall 111 to provide a watertight container for the candle block 120. The inner liner can have an exposed portion across the aperture 114 to define a button 134. A rim 112 can be attached to the wall 111 opposite the base 113 and can be configured to extend into the candle holder 110 at least the thickness of the inner liner 130 and to secure the inner liner 130 within the candle holder 110. The rim 112 can be attached to the candle holder 110 by threading the rim 112 onto the candle holder 110 to provide a snug fit between the rim 112 and the inner liner 130 and hold to the inner liner 130 within the candle holder 110.

The candle holder 110 can include an inner liner 130 made from a material such as silicon, polytetrafluoroethylene, polyimide, PEEK, PPS, nylon, acetal, polyester, or other non-stick plastics and rubber materials. The inner liner 130 can be designed a separate insert for the candle holder 110 or integrated into the wall 111 of the candle holder 110. The aperture 114 in the base 113 of the candle holder 110 is configured to expose a portion 132 of the inner liner 130 at the aperture 114. The exposed portion 132 of the inner liner 130 is arranged to extend through the aperture 114 and define a button 134. The button 134 or portion 132 that extends through the aperture 114 is made from a flexible material to allow a user to push the button 134 and apply pressure to the bottom of the candle block 120 to release the candle block 120 from the candle holder 110. To remove the candle block 120, whether spent or switching out a candle scent, the user can press the button 134 to apply pressure to the candle block 120 and release the tension between the inner surfaces 136 of the inner liner 130 and the remaining wax residue or wax block of the candle block 120 to discharge the hardened wax.

The inner liner 130 is configured to fit tightly against the inside surface defined by the wall 111 and across the entire base 113 within the candle holder 110. The inner liner 130 provides a barrier between the candle block 120 and the candle holder 110. The inner liner 130 has a nodule sized to fit within the aperture 114 and through the thickness of the base 113 to define a button 134.

The inner liner 130 may be adhered to the wall 111 of the candle holder 110 using an adhesive, such as epoxy adhesives, polyurethane adhesives, and polyurethane adhesives. The inner liner 130 may also be formed into the candle holder 110 using a mold, spray or dipped coating, or other methods known to form an inner wall within a container. Further, the inner liner 130 may be inserted into the candle holder 110 and designed to have a tight fit to not require the inner liner 130 to be adhered to the wall 111 of the candle holder 110. The inner liner 130 is designed to remain inside the candle holder 110 when a user presses the button 134 to release the candle block 120. When the inner liner 130 is made from a rigid material or is firmly attached to the wall 111 of the candle holder 110, the portion 132 placed over the aperture 114 should be made from a pliable material to allow the button 134 to be pressed against the candle block 120 to move the candle block 120 sufficiently to release the tension between the wall 111 and the candle block 120.

In another aspect of the invention, the inner liner 130 is structured to fit tightly against the wall 111 of the candle holder 110. The tight fit connection secures the inner liner 130 sufficiently to secure the inner liner against the wall 111 of the candle holder 110 and prevent the inner liner 130 from disassembling from the candle holder 110 when the button 134 is pressed against the candle block 120. The inner liner 130 is not required to be a removable piece and may be fixed inside when the candle block 120 is replaced. The candle holder 110 may also include a ridge 115 placed around the rim 112 of the wall 111 and configured to hold in the inner liner 130 within the candle holder 110. The ridge 115 may be formed as a continuous piece of the wall 111 or a separate piece that is affixed to the wall 111. The ridge 115 is configured to extend within the inner space of the candle holder 110 and sized to cover the thickness of the inner liner 130. The ridge 115 may be affixed to the wall 111 using an adhesive, a snap fit connection, threaded connection, or other methods know to affix two different materials together.

The inner liner 130 may have a cylindrical, conical, tapered conical, cubic, or other shape with straight walls. The inner liner 130 can have an outer surface that is configured to match the inside of the wall 111 of the candle holder 110. The inner surface 136 of the inner liner 130 can have a tapered conical shape that tapers from a thin wall at the top to a thicker wall at the bottom to enhance the ease of removing the candle block 120. The inner liner 130 can provide a non-stick surface to allow the wax, in liquid, solid or semi-solid form to be removed or replaced from the candle holder 110 at any stage of use, whether at the beginning, middle or end of the use of the candle block. Preferably, the used wax is removed in a solid state to prevent possible burns to the user. The inner liner 130 can have a nodule 137 at the bottom surface 138 that is configured to fit within at least a portion of the aperture 114 of the candle holder 110 and define the button 134. The nodule 137 can extend down into the aperture 114 a distance that is substantially equal to the thickness of the base 113 at the aperture 114 and allow the user to access the button 134. The distance may be a portion or the entire distance of the thickness of the aperture 114. The candle block 120 can be replaced to switch the scented candle wax by pushing the button 134 on the bottom of the candle holder 110 to remove the old wax and replace with a new candle block 120 inside the candle holder 110. The new candle block can be a wax block that is sized to fit within the inner liner 130. The new candle block 120 is placed in the candle holder 110 and may be used until spent, where the wax is discharged and replaced again. The remaining wax residue or remaining candle block can be replaced at any time.

As shown in FIGS. 5-10, 12 and 13, the inner liner 130 may include a well 139 at the bottom surface 138. The extra thickness of the wax in the well 139 provides additional volume in the wax at the aperture 114, which can assist with the release of the candle block 120 or remaining wax. The inner liner 130 may also include a hollow ring around the aperture 114 to provide flexibility at the point of release and ease of pushing the button 134. The candle block 120 may also include a center bump that is designed to fit within the well 139 of the inner liner 130.

The aperture 114 at the bottom of the candle holder 110 allows the users to discharge the candle block after use without messy clean-up and requiring the inner liner 130 to be separated from the candle holder 110. In the present invention, the inner liner 130 is not required to be removed when replacing the candle block 120. If the inner liner 130 is removed with the candle block 120, the inner liner 130 may be difficult to reinsert into the candle holder 110, for instance, if the inner liner 130 becomes deformed over time from exposure to the heat of the candle 100.

Figure 11:
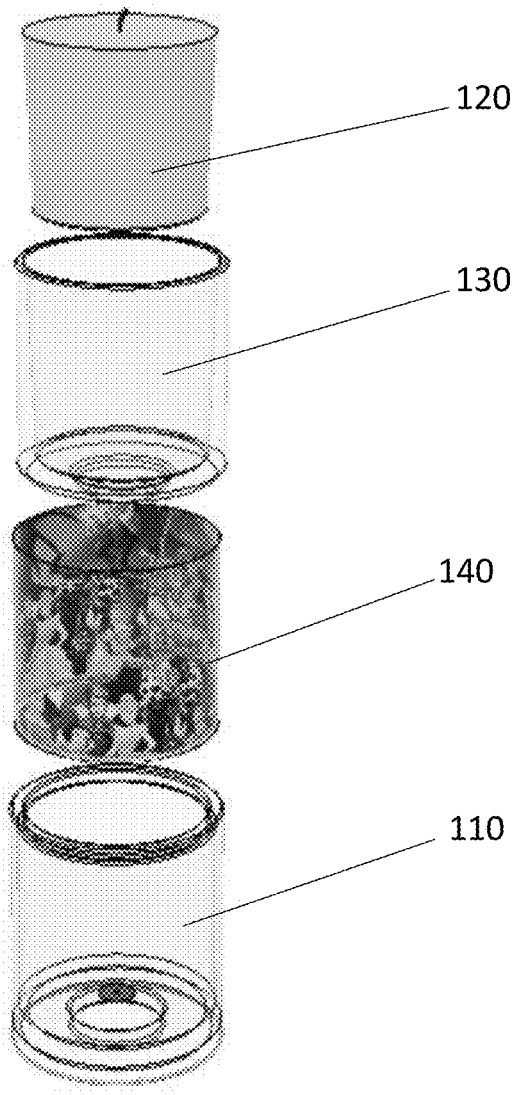
FIG. 11 is a top view of a candle assembly illustrating the candle holder, inner liner design wrap and candle block.
Figure 12:
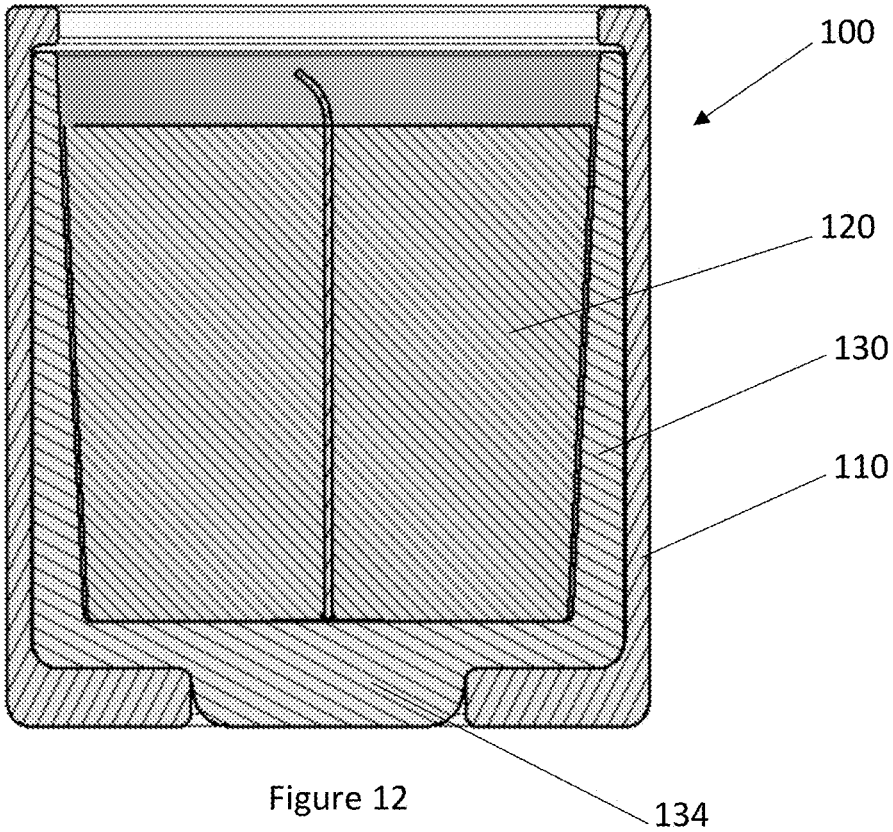
FIG. 12 is a cross-sectional view of a candle assembly in accordance with an embodiment of the present invention.
Figure 13:
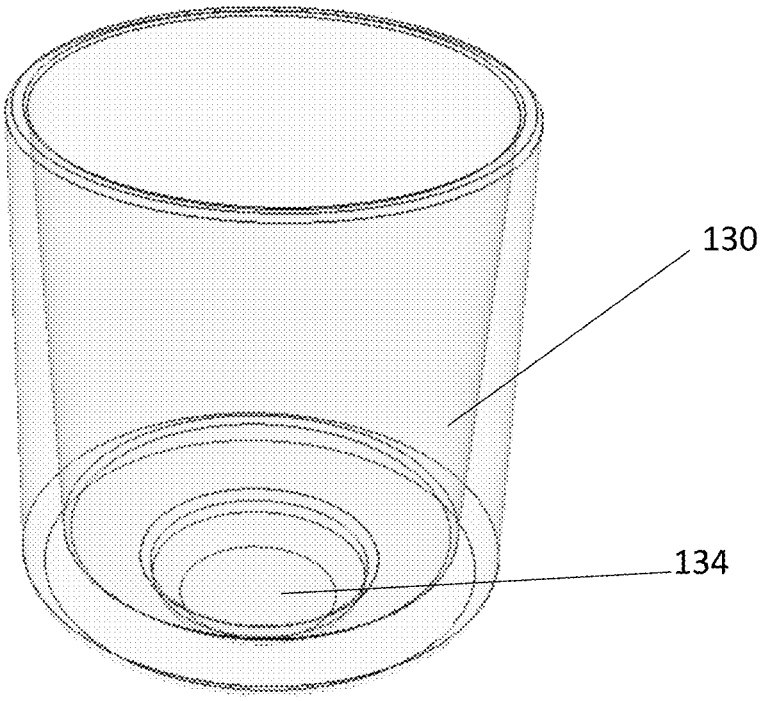
FIG. 13 is an isometric view of an inner liner in accordance with an embodiment of the present invention.

FIG. 11 illustrates another aspect of the invention. The candle 100 may include a design wrap 140 that is sized to wrap around the outer surface of the candle holder 110. The design wrap 140 can include various personal designs and patterns. The design wrap 140 may be affixed to the outer surface with a semi-permanent adhesive or have a removable slip-on design. The design wrap 140 may also be placed between the inner liner 130 and the candle holder 110. The candle holder 110 can be manufactured from a transparent or semi-transparent material to allow the design wrap to be viewed through the wall 114.

In another aspect of the invention, the candle 100 may include a lid 150. When the lid 150 is included as an option, the lid 150 can cover the candle when not in use to protect the wax block 120 from outside elements, defining a closed position. The lid 150 can include a lid ridge 152 on the bottom surface 154 to press fit against the rim 112 of the candle holder 110 when in the closed position. The lid ridge 152 can also serve as stand when the lid 150 is placed under the candle holder 110, defining an open position. By placing the lid 150 under the candle holder 110, the heat from the candle 100 is insulated from other surfaces to reduce the amount of heat transmitted to the surfaces and possible damage that the candle 100 may cause to the surfaces. The lid 150 can also include a center protuberance 156 that extends above the top surface of the lid 150. The center protuberance 156, when place under the candle holder 110, is designed to extend inside the aperture 114 and provide a lower support for the inner liner 130 when in the open position. When the lid 150 is place on top of the candle holder 110, the lid 150 will act as a snuffer to put out the flame.

The candle block 120 is manufactured by placing wax chunks or shavings in a container or double boiler. The candle block 120 cannot be placed directly on the heat or the wax will catch fire or evaporate. The wax is heated until completely melted. A thermometer may be used melt the wax at proper temperature. Paraffin wax should be melted at temperatures between 122 and 140° F. (50 and 60° C.). Soy wax should be melted at temperatures between 170 and 180 degrees (76.6 and 82.2° C.). Beeswax should be melted at about a temperature of 145 degrees (62.7° C.) and should not exceed 175 degrees (79.4° C.). The wax is placed in a mold to form a candle block 120 that is designed to fit within the inner liner 130 and to create a center bump that is designed to fit within the well of the inner liner 130.

A fragrance can be added to the melted wax. The fragrance can be an essential oil, combination of fragrances or other scent additive. The fragrance is mixed with the wax until completely stirred in.

A color can also be added to the wax. The coloring should be an oil-based dye. Additional colors may be added to the melted wax to achieve the right consistency and to achieve a certain final desired color.

At least one wick 122 is placed in the center of the candle mold. The wick 122 can be placed in the center of the candle mold or at a desired location, or desired locations if placing more than one wick in the candle 100. The wick 122 should be sized to extend above the top of the candle surface.

The mold is shaped to fit into the inner liner 130 of the candle holder 110. The wax is poured into the mold and cooled. The wax should be cooled for about 24 hours for paraffin waxes. Soy wax generally takes about 4 to 5 hours to cool and Beeswax candles generally takes about 6 hours to cool. Longer cooling times are better and generally help the candles set up.

The wax is removed from the mold and the wick is trimmed to an acceptable starting length for the candle wicks. The length of the initial wick is sized to provide a proper burn of the flame when lit. If the wick 122 is too long, the flame may be too large and release black smoke or soot.

The candle holder 110 can be manufactured from glass, tin, ceramic, aluminum or other material that is known to withstand the heat of a lit candle block 120. These and other reports can be generated depending on the need and information tracked as will be understood by one of ordinary skill in the art.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A candle assembly, comprising:

a candle block made substantially of a wax and including at least one wick;

a candle holder having a cylindrical wall with an opening and a base, the cylindrical wall defining a continuous inside surface around the base, the base positioned opposite the opening and including an aperture extending through the thickness of the base;

an inner liner configured to fit tightly against the inside surface defined by the cylindrical wall and across the entire base within the candle holder, the inner liner providing a barrier between the candle block and the candle holder, the inner liner having a nodule sized to fit within the aperture and through the thickness of the base to define a button; and a rim attached around the cylindrical wall of the candle holder and configured to extend into the inner space of the candle holder to secure the inner liner within the candle holder.

2. The candle assembly of claim 1, further comprising a lid sized to fit around the rim and cover the opening of the candle holder to enclose the candle block.

3. The candle assembly of claim 2, wherein the lid includes a lid ridge to fit the candle holder on the lid when in an open position.

4. The candle assembly of claim 3, wherein the lid includes a center protuberance configured to align with the aperture of the candle holder.

5. The candle assembly of claim 1, wherein the rim is attached to the candle holder to provide a snug fit between the rim and the inner liner and hold to the inner liner within the candle holder.

6. The candle assembly of claim 1, wherein the inner liner includes an exposed portion passing over the aperture to define the button.

7. The candle assembly of claim 1, wherein the inner liner is adhered to the cylindrical wall of the candle holder using an adhesive.

8. The candle assembly of claim 1, wherein the inner liner is formed into the candle holder.

9. The candle assembly of claim 1, wherein the inner liner has a tapered conical shape to with a thinner wall at the top and thicker wall at the bottom of the inner liner.

10. The candle assembly of claim 1, wherein the inner liner includes a well at the bottom surface.

11. The candle assembly of claim 10, wherein the candle block includes an extra thickness configured to fit within the well.

12. The candle assembly of claim 1, wherein the inner liner includes a hollow ring positioned around the aperture.

13. The candle assembly of claim 1, further comprising a design wrap positioned between the inner liner and the candle holder.

14. A candle assembly, comprising:

a candle holder configured to hold a candle block, the candle holder having an opening, a wall and a base, the wall attached around the periphery of the base, the opening positioned opposite the base, the base including an aperture extending through the thickness of the base;

an inner liner placed in the candle holder and configured to fit tightly against the wall and to provide a watertight container for the candle block, the inner liner having an exposed portion across the aperture to define a button; and a rim attached to the wall opposite the base and configured to extend into the candle holder at least the thickness of the inner liner and to secure the inner liner within the candle holder.

15. The candle assembly of claim 14, wherein the inner liner includes a nodule configure to fit in the aperture of the candle holder to define the button.

16. The candle assembly of claim 14, wherein the inner liner is adhered to the wall of the candle holder using an adhesive and includes a flexible exposed portion over the aperture.

17. The candle assembly of claim 14, wherein the inner liner is formed into the candle holder and includes a flexible exposed portion over the aperture.

18. The candle assembly of claim 14, wherein the inner liner has a tapered conical shape to with a thinner wall at the top and thicker wall at the bottom of the inner liner.

19. The candle assembly of claim 14, further comprising a lid sized to fit around the rim and cover the opening of the candle holder to enclose the candle block.

* * * * *